US007470153B2

(12) United States Patent
Han et al.

(10) Patent No.: US 7,470,153 B2
(45) Date of Patent: Dec. 30, 2008

(54) AUDIO JACK WITH IMPROVED CONTACT ARRANGEMENT

(75) Inventors: Hong-Qiang Han, Kunshan (CN); Zi-Qiang Zhu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/725,699

(22) Filed: Mar. 19, 2007

(65) Prior Publication Data

US 2007/0218774 A1 Sep. 20, 2007

(30) Foreign Application Priority Data

Mar. 17, 2006 (CN) ..... 2006 2 0070374 U

(51) Int. Cl.
*H01R 24/04* (2006.01)

(52) U.S. Cl. ..... 439/669

(58) Field of Classification Search ..... 439/668, 439/669, 188; 200/51.1
See application file for complete search history.

(56) References Cited

U.S. PATENT DOCUMENTS 4,367,907 A * 1/1983 Buck ..... 439/188
6,270,380 B1 8/2001 Shichida
6,312,274 B1 * 11/2001 Lin ..... 439/188
6,478,594 B1 * 11/2002 Curtin et al. ..... 439/188
6,568,963 B2 * 5/2003 Zhang et al. ..... 439/668
6,690,801 B2 2/2004 Yeh
6,808,404 B1 * 10/2004 Doyle et al. ..... 439/188
7,238,059 B1 * 7/2007 Wu ..... 439/668
2006/0166561 A1 * 7/2006 Ma ..... 439/668

* cited by examiner

*Primary Examiner*—T C Patel
*Assistant Examiner*—Vladimir Imas
(74) *Attorney, Agent, or Firm*—Wei Te Chung

(57) ABSTRACT

An audio jack (100) for electrically connecting a mating plug (200) includes an insulative housing (10) and a number of electrical contacts (21, 22, 23, 24) retained therein. The insulative housing (10) has a first sidewall (11), a second sidewall (12) opposite to the first sidewall, and a plug-insertion hole (15) extending in a longitudinal direction thereof. Each electrical contact (21, 22, 23, 24) includes a mating portion (212, 222, 232, 242), a retaining portion (211, 221, 231, 241) and a solder portion (213, 223, 233, 243). The retaining portions (211, 221, 231, 241) are engaged with the first sidewall (11). The mating portion (212, 222, 232, 242) and the retaining portion (211, 221, 231, 241) of the electrical contacts (21, 22, 23, 24) are located on the same side of the insulative housing (10).

18 Claims, 5 Drawing Sheets

AUDIO JACK WITH IMPROVED CONTACT ARRANGEMENT

BACKGROUND OF THE INVENTION

1. Field of the Invention

This invention generally relates to an audio jack, and more particularly to an audio jack with improved contacts arrangement.

2. Description of the Prior Art

U.S. Pat. No. 6,270,380 discloses a conventional audio jack connector for receiving an audio plug comprising an insulative housing and a plurality of contacts accommodated in the insulative housing. The insulative housing includes a pair of sidewalls and a plug-insertion hole extending therebetween. The contacts are disposed on two sides of the plug-insertion hole. For receiving the contacts therein and providing reliable electrical connection with the audio plug, the thickness of each sidewall must be sufficient. Thus, it is difficult to reduce the dimension of the audio jack. With the development of electronic industry, miniaturization is current trend. However, the conventional audio jack is not suitable to the trend.

Hence, it is desired to have a miniature audio jack with improved contact arrangement therefore solving the problem above.

BRIEF SUMMARY OF THE INVENTION

Accordingly, an object of the present invention is to provide a miniature audio jack with improved contacts arrangement.

In order to attain the object above, an audio jack for electrically connecting a mating plug, comprises an insulative housing and a plurality of electrical contacts retained therein. The insulative housing comprises a first sidewall, a second sidewall opposite to the first sidewall, and a plug-insertion hole extending in a longitudinal direction thereof. Each electrical contact comprises a mating portion, a retaining portion and a solder portion. The retaining portions of the electrical contacts are engaged with the first sidewall. The mating portion and the retaining portion of the electrical contacts are located on the same side of the insulative housing.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Reference will now be made in detail to the preferred embodiment of the present invention.

Figure 1:
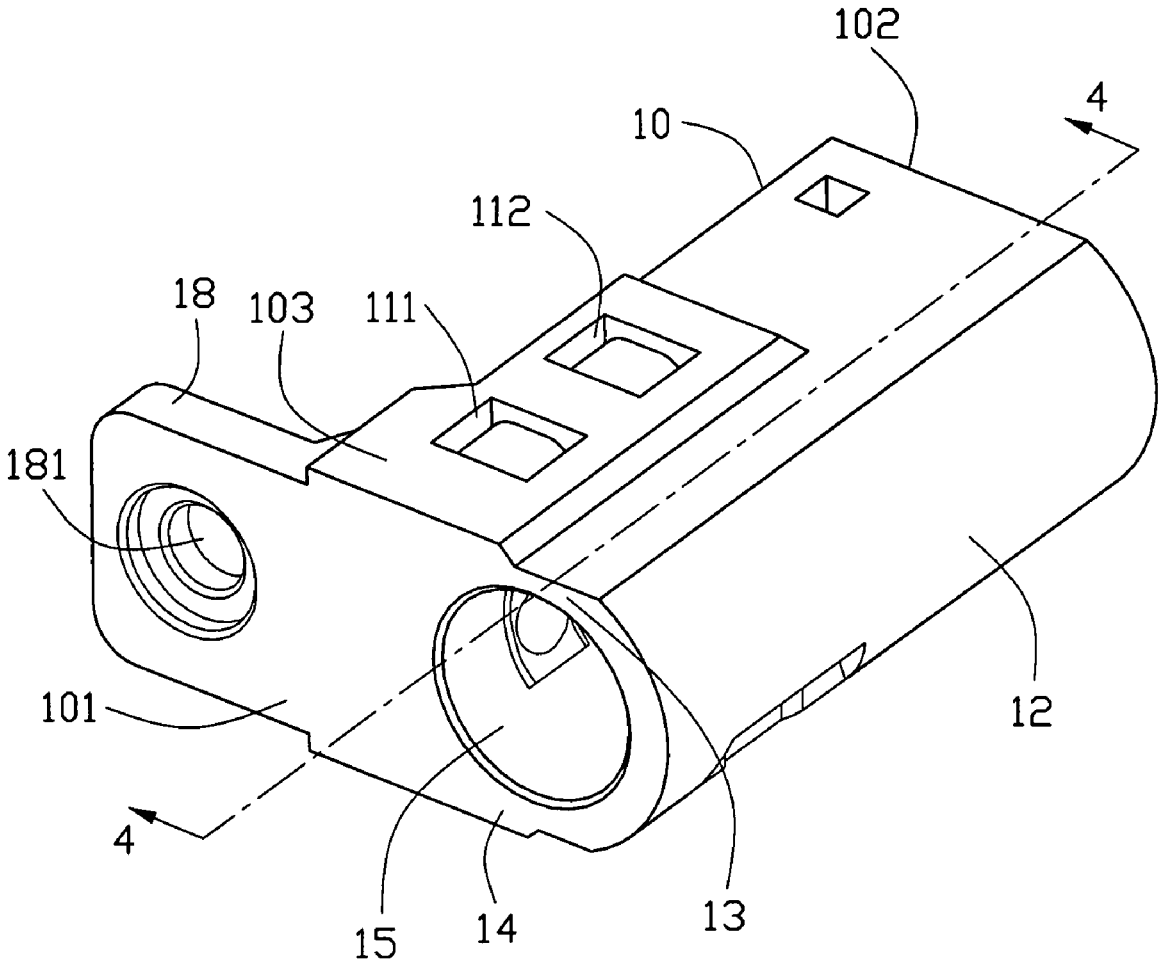
FIG. 1 is a perspective view of an audio jack according to the present invention.
Figure 2:
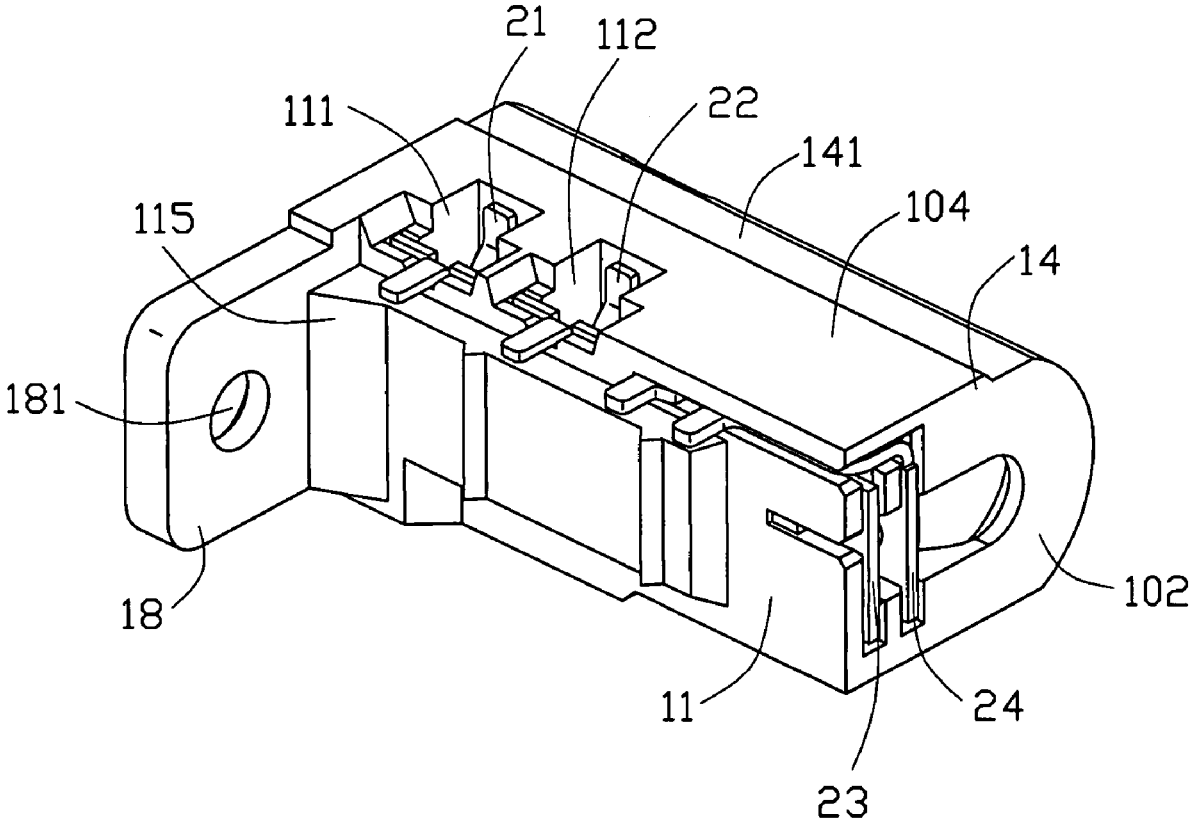
FIG. 2 is another perspective view of the audio jack, shown in FIG. 1, while view from another aspect.

Referring to the drawings and in particular to FIGS. 1-2, an audio jack 100 in accordance with the present invention for electrically connecting a mating audio plug 200 (shown in FIG. 5), comprises an insulative housing 10, a plurality of contacts 21, 22, 23, 24 retained in the insulative housing 10, and a supporting member 31.

Referring to FIGS. 1-5, the insulative housing 10 comprises a first sidewall 11, a second sidewall 12, a top wall 13 and a bottom wall 14 opposite to the top wall 13. The top wall 13 and the bottom wall 14 are connected with the first and the second sidewall 11, 12. The insulative housing 10 defines a plug-insertion hole 15 extending between the first and the second sidewall 11, 12 in a longitudinal direction of the insulative housing 10 for receiving the audio plug 200. The insulative housing 10 has a front face 101, a rear face 102 paralleled to the front face 101, a top face 103 perpendicular to the front face 101, and a bottom face 104 paralleled to the top face 103.

The first sidewall 11 is straight and defines a plurality of recesses 111, 112, 113, 114 for receiving the electrical contacts 21, 22, 23, 24. The recesses 111, 112 are extending from the bottom face 104 and open to the top face 103. The recesses 113, 114 are extending from the rear face 102 and opens to an outer face of the first sidewall 111. The recesses 111, 112 are juxtaposed in a transversal direction of the insulative housing 10. The recesses 111, 112, 113 are disposed along the longitudinal direction of the insulative housing 10. A flange 18 extends outwardly from the first sidewall 11 of the insulative housing 10 and defines a sink hole 181 therein. There is a reinforcing protrusion 115 being provided at a joint of the first sidewall 11 and the flange 18. The second sidewall 12 is curved and defines an opening 121 thereon. The bottom wall 14 of the insulative housing 10 includes a step portion 141 under the second sidewall 12.

Figure 3:
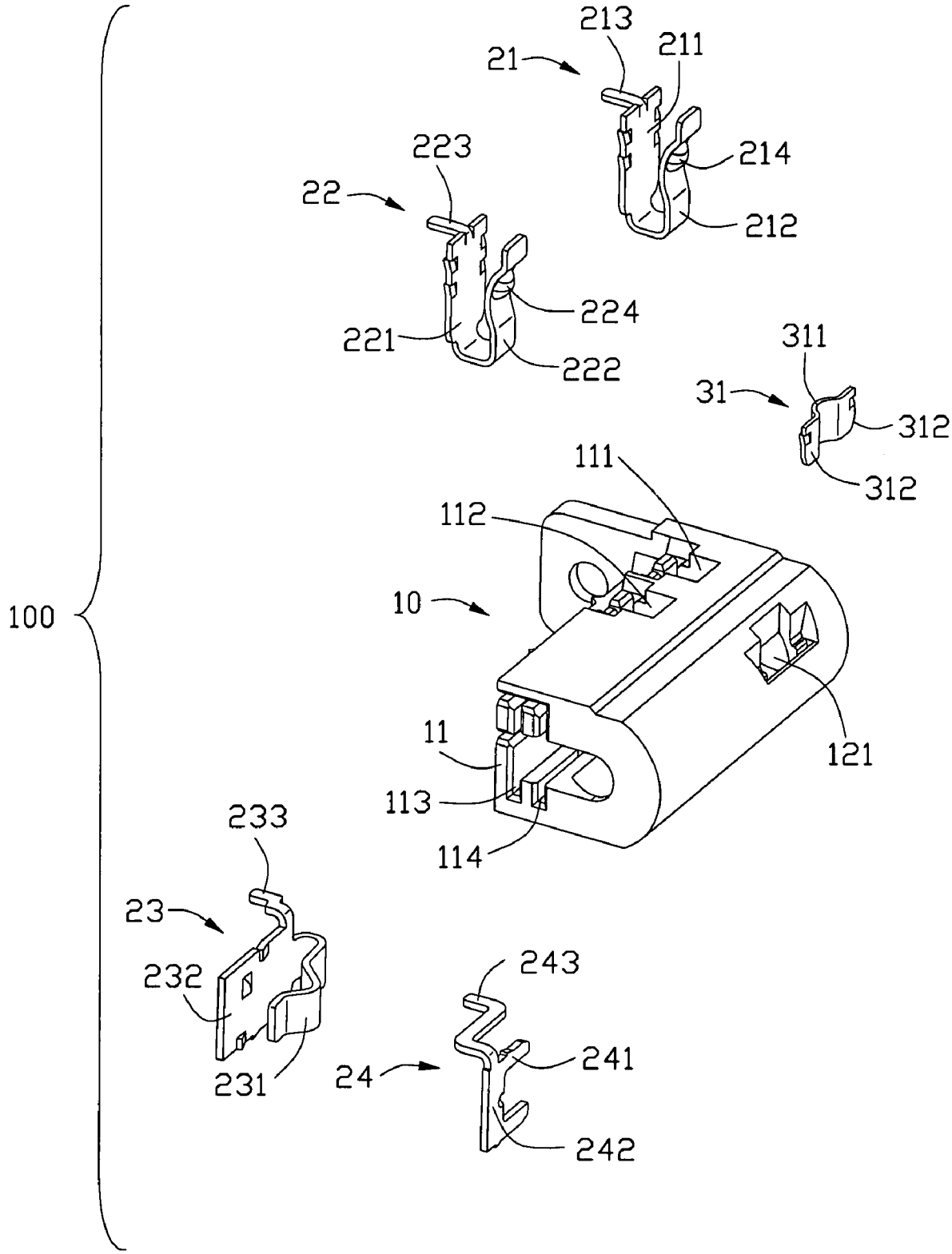
FIG. 3 is an exploded view of the audio jack shown in FIG. 1.
Figure 4:
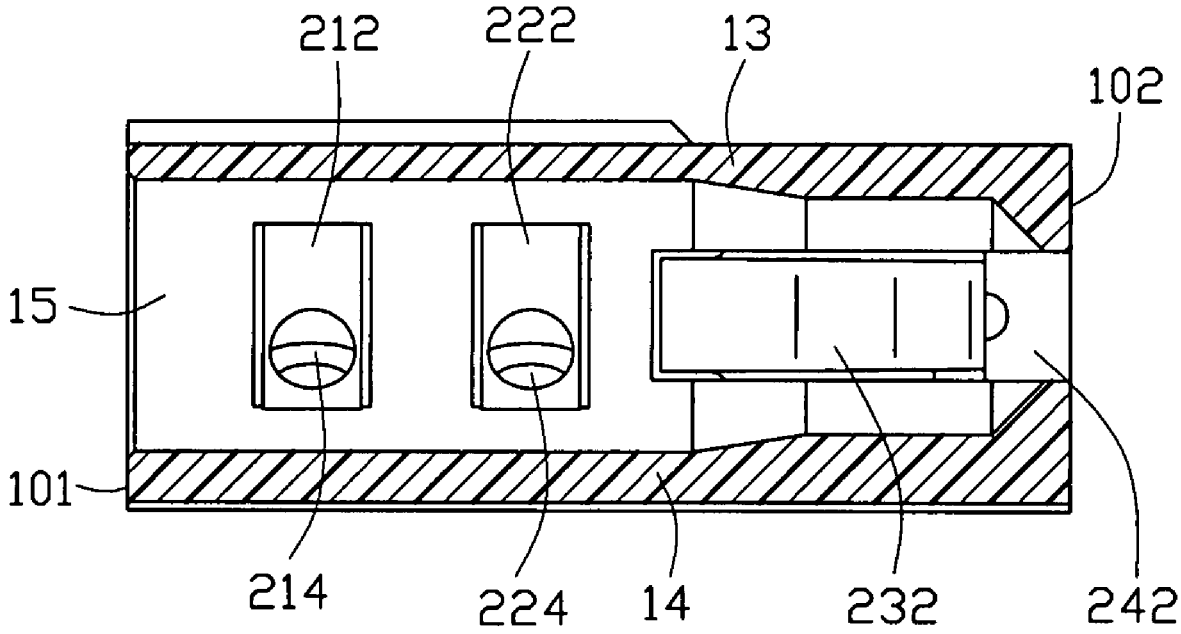
FIG. 4 is a cross-section view of the audio jack taken along line 4-4 shown in FIG. 1.

Referring to FIG. 3, the electrical contacts include a first mating contact 21, a second mating contact 22, a first switch contact 23, and a second switch contact 24 for mounting on an electrical device (not shown). The electrical contacts 21, 22, 23, 24 are accommodated in the recesses 111, 112, 113, 114 respectively of the first sidewall 11.

Each electrical contact 21, 22, 23, 24 comprises a mating portion 212, 222, 232, 242, a retaining portion 211, 221, 231, 241 engaging with the first sidewall 11, and a solder portion 213, 223, 233, 243 extending out of the insulative housing 10. The mating portion 212, 222, 232, 242 and the retaining portion 211, 221, 231, 241 of the electrical contacts 21, 22, 23, 24 are located on the same side of the insulative housing 10. The solder portions 213, 223, 233, 243 of the electrical contacts 21, 22, 23, 24 are located on the same side as the retaining portions 211, 221, 231, 241 so that the electrical contacts 21, 22, 23, 24 are located on the same side of the insulative housing 10.

The first and the second mating contacts 21, 22 are attached to the insulative housing 10 from the bottom face 104 thereof. The first and the second switch contacts 23, 24 are attached to the insulative housing 10 from the rear face 102. The mating portions 212, 222, 232 of the first mating contact 21, the second mating contact 22, and the first switch contact 23 are projected into the plug-insertion hole 15 for mating with the audio plug 200 and arranged along the longitudinal direction of the insulative housing 10. The mating portion 212, 222, 232 and the retaining portion 211, 221, 231 of each electrical contact 21, 22, 23 are space apart along the transversal direction of the insulative housing 10. The first and second mating contact 21, 22 are U-shaped and each comprises a project portion 214, 224 on the mating portion 212, 222 for contacting with the audio plug 200. The mating portion 242 of the second switch contact 24 contacts with the mating portion 232 of the first switch contact 23 before the audio plug 200 insertion.

The supporting member 31 is attached to the opening 121 of second sidewall 12 of the insulative housing 10. The supporting member 31 includes a mating portion 311 extending into the plug-insertion hole 15 and a pair of retaining portions 312 for engaging with the second sidewall 12.

Figure 5:
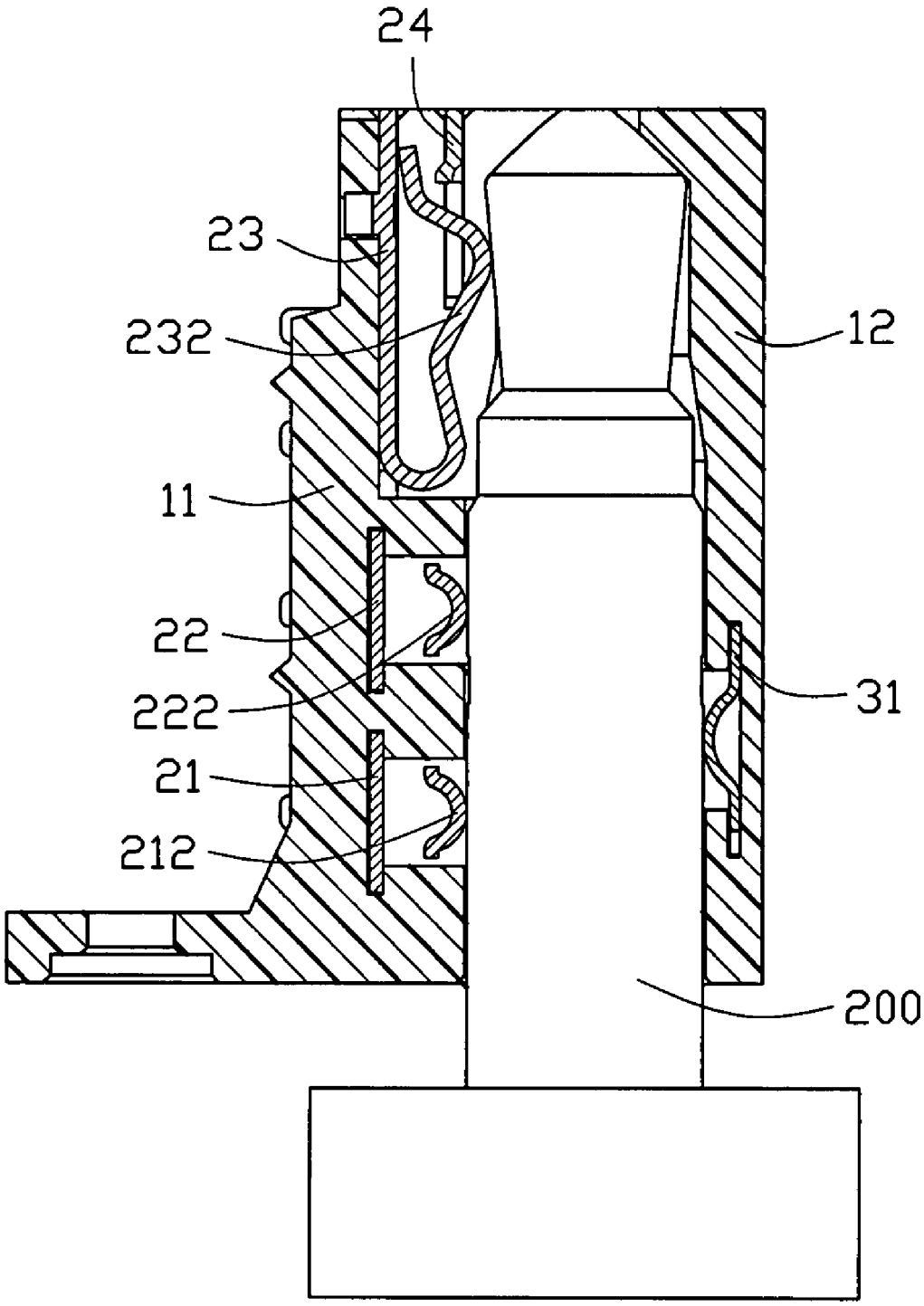
FIG. 5 a cross-section view of the audio jack of FIG. 1 with an audio plug inserted therein.

Referring to FIG. 5, when the audio jack 100 mating with the audio plug 200, the first mating contact 21 and the second mating contact 22 contact with the audio plug 200 for establishing electrical connection. With the further insertion of the audio plug 200, the first switch contact 23 is contact with the audio plug 200 and moved outwardly. The mating portion 232 of the first switch contact 23 and the mating portion 242 of the second switch contact 24 are separate to detect the insertion of the audio plug 200. The second switch contact 24 does not contact with the audio plug 200 all along.

Comparing with the prior art, all the electrical contacts 21, 22, 23, 24 mounted to the electrical device are arranged on the same side of the insulative housing 10 or the plug-insertion hole 15. With this arrangement, the second sidewall 12 does not assemble any electrical contacts. The thickness of the second sidewall 12 is reduced and smaller than the first sidewall 11. Therefore, the size of the audio jack 100 can reduced efficiently.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

We claim:

1. An audio jack for electrically connecting a mating plug, comprising:

an insulative housing comprising a first sidewall, a second sidewall opposite to the first sidewall, and a plug-insertion hole extending in a longitudinal direction thereof; and a plurality of electrical contacts retained in the housing and said electrical contacts each comprising a mating portion for contacting with the mating plug, a retaining portion engaging with the first sidewall and a solder portion, the mating portion and the retaining portion of the electrical contacts locating on one side of the insulative housing and the other side of the insulative housing without said electrical contact; wherein the electrical contacts include a first mating contact, a second mating contact, a first switch contact, and a second switch contact, and the first and second mating contact are U-shaped.

2. The audio jack according to claim 1, wherein the solder portion of the electrical contact extends out of the insulative housing and is located on the same side as the retaining portion.

3. The audio jack according to claim 1, wherein the mating portions of the first mating contact, the second mating contact, and the first switch contact are projected into the plug-insertion hole and arranged along the longitudinal direction.

4. The audio jack according to claim 1, wherein the mating portion and the retaining portion of the first mating contact, the second mating contact, and the first switch contact are spaced apart along a transversal direction of the insulative housing.

5. The audio jack according to claim 1, wherein the first and the second mating contact each comprises a project portion on the mating portion for contacting with the mating plug.

6. The audio jack according to claim 1, further comprising a supporting member attached to the insulative housing, and the supporting member including a mating portion extending into the plug-insertion hole and a pair of retaining portion engaging with the second sidewall.

7. The audio jack according to claim 1, wherein the first sidewall is thicker than the second sidewall.

8. The audio jack according to claim 1, wherein the insulative housing comprises a top wall connecting with the first and the second sidewall and a bottom wall opposite to the top wall, the bottom wall comprising a step portion under the second sidewall.

9. The audio jack according to claim 1, wherein the insulative housing comprises a flange extending outwardly from the first sidewall with a sink hole defined therein.

10. The audio jack according to claim 9, wherein the insulative housing comprises a reinforcing protrusion at a joint of the first sidewall and the flange.

11. An audio jack for electrically connecting an audio plug, comprising:

an insulative housing including a straight sidewall, a curved sidewall opposite to the straight sidewall, and a plug-insertion hole extending therebetween in a longitudinal direction thereof;

a plurality of electrical contacts attached to the insulative housing and each including a retaining portion attached to the straight wall, a mating portion extending from the retaining portion, and a solder portion extending out of the insulative housing, the electrical contacts being arranged on the same side of the plug-insertion hole.

12. The audio jack according to claim 11, wherein the straight sidewall is thicker than the curved sidewall.

13. The audio jack according to claim 11, wherein at least one of the electrical contacts does not contact with the audio plug, and other electrical contacts mate with the audio plug along a transversal direction of the insulative housing.

14. The audio jack according to claim 13, wherein the mating portion and the retaining portion of the electrical contacts mating with the audio plug are space apart along the transversal direction.

15. An electrical connector comprising:

an insulative housing defining a columnar plug receiving cavity therein for receiving a plug, said housing further defining a rectangular main body section with an arch-like roof section to comply with said columnar receiving cavity; and a plurality of contacts disposed in the housing with contacting portions extending into the plug receiving cavity; wherein a horizontal retaining slot is only formed in the roof section which downwardly communicates with the plug receiving cavity to allow a metallic supporting member not only to be sidewardly assembled thereinto but also to be vertically aligned with an axial center line of said roof section for assuring a symmetric downward force imposed to the plug received in the plug receiving cavity

16. The electrical connector as claimed in claim 15, wherein said arc-like roof section extends along a front-to-back direction throughout the whole housing.

17. The electrical connector as claimed in claim 15, wherein a bottom portion of the housing further defines two passageways through one side wall of the housing, and two of said contacts are sidewardly inserted into the corresponding passageways, respectively.

18. The electrical connector as claimed in claim 17, wherein when said plug is inserted into the plug receiving cavity, said two of the contacts respectively engage said plug at two spaced positions along a front-to-back direction, and said supporting member engages said plug at another position between said two spaced positions along said front-to-back direction.

* * * * *